US006373476B1

(12) United States Patent
Dalgleish et al.

(10) Patent No.: US 6,373,476 B1
(45) **Date of Patent: *Apr. 16, 2002**

(54) DISPLAY APPARATUS WITH SELECTABLE COMMUNICATION PROTOCOL

(75) Inventors: Stuart Neilson Dalgleish; David J. Eagle; Mark Wayne Huggins; Neil Wright-Boulton, all of Renfrewshire (GB)

(73) Assignee: International Business Machines Corporation, Armonk, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/894,884

(22) PCT Filed: Oct. 10, 1995

(86) PCT No.: PCT/GB95/02398

§ 371 Date: Aug. 29, 1997

§ 102(e) Date: Aug. 29, 1997

(87) PCT Pub. No.: WO97/00512

PCT Pub. Date: Jan. 3, 1997

(30) Foreign Application Priority Data

Jun. 15, 1995 (GB) ..... 9512126

(51) Int. Cl.[7] ..... G09G 5/00

(52) U.S. Cl. ..... 345/204

(58) Field of Search ..... 345/172, 173, 345/156, 157, 112, 3, 12, 20, 364, 204, 698, 699, 1.2, 3.4

(56) References Cited

U.S. PATENT DOCUMENTS

| | | | | | |
|---|---|---|---|---|---|
| 5,449,984 | A | * | 9/1995 | Sawdon et al. | 315/186 |
| 5,457,473 | A | * | 10/1995 | Arai et al. | 345/10 |
| 5,483,260 | A | * | 1/1996 | Parks et al. | 345/156 |
| 5,654,738 | A | * | 8/1997 | Spurlock | 345/132 |
| 5,691,741 | A | * | 11/1997 | Kerigan et al. | 345/112 |
| 5,694,213 | A | * | 12/1997 | Gable | 345/132 |
| 5,710,570 | A | * | 1/1998 | Wada et al. | 345/3 |
| 5,727,191 | A | * | 3/1998 | Konishi et al. | 395/507 |
| 5,828,351 | A | * | 10/1998 | Wu | 345/3 |
| 5,877,745 | A | * | 3/1999 | Beeteson et al. | 345/156 |

FOREIGN PATENT DOCUMENTS

| | | | |
|---|---|---|---|
| DE | 9215701 | 1/1993 | H01R/13/70 |
| EP | 0448267 | 9/1991 | H04N/17/04 |
| EP | 0665525 | 8/1995 | G09G/1/16 |

OTHER PUBLICATIONS

IBM Technical Disclosure Bulletin vol. 37, No. 06B, Jun. 1994 pp. 543–552, "ID–Bit Architecture for Displays", New York, NY.

* cited by examiner

*Primary Examiner*—Richard Hjerpe
*Assistant Examiner*—Ronald Laneau
(74) *Attorney, Agent, or Firm*—Edward H. Duffield

(57) ABSTRACT

A display apparatus: a display screen on which a display drive generates a picture in response to picture information (R,G,B,H.V) from a video source connected via a releasable connector to the display apparatus. User controls adjust the picture generated by the display drive in response to a manual input. Selection controls are included for selecting one of a plurality of sets of control data for communication to the video source in response to a configuration code input via the user controls.

9 Claims, 1 Drawing Sheet

DISPLAY APPARATUS WITH SELECTABLE COMMUNICATION PROTOCOL

The present invention relates to display apparatus having selectable communication protocol for use in a personal computer system.

A personal computer system typically comprises a computer system unit having: a memory, including a mass storage device such as a hard disk drive, for storing data and computer program instructions; and, a microprocessor for manipulating the data stored in the memory according to the instructions of the computer program. User input means comprising a keyboard and pointing device such as a mouse are connected to the system unit to permit a user to control execution of program code by the system unit. Display apparatus, such as a cathode ray tube display, liquid crystal display panel, or the like, is connected to the system unit to display data manipulated by the system unit to the user. The program code typically comprises application software such as a word-processor and operating system software for managing execution of the application software by the system unit. Device driver software configures the system unit to communicate data between the application software and peripheral devices such as the display apparatus. Operating system and application software products are typically supplied with a range of device drivers from which a user selects the appropriate driver for a particular personal computer configuration. However, there is now such a wide range of display devices available for connection to personal computer system units that it can be difficult to select the appropriate device driver for a particular display. If the correct device driver is not loaded, the performance of the display will not be optimised. In particular, if parameters specific to the display device, such as maximum refresh rate, are not set to the right value in the system unit, objectionable front of screen performance, such as flicker, may result in the display device.

With a view to solving the above problem, the Video Electronics Standards Association (VESA) has produced a communication protocol standard for a Display Data Channel (DDC). DDC establishes a serial communication link between the display device and the system unit of a personal computer system. The link enables the system unit to read a data file containing Extended Display Identification Data (EDID) from the display device. The EDID describes the operational capabilities of the display device DDC thus enables the system unit to load the optimum device drivers for the display device without any user intervention. DDC is designed around a 15 pin "D shell" connector. This type of connector is generally used by the PC industry to connect the display device to a video adaptor of the system unit. There are three types of DDC specified: DDC1;

DDC2B; and DDC2AB. In DDC1, the system can only read the EDID from the display device. In DDC2B and DDC2AB can both read data from and write data to the display device. DDC2B and DDC2AB use signal lines in the connector which were used to provide identification (ID) bits 1 and 3 from the display device to the video adaptor in previous identification schemes. DDC1 uses only the line previously assigned to ID bit 1. The identification bits allowed previous system units (such as the IBM PS/2 range of system units) to recognise which type of display device is attached and hence decide which video modes were supported. This was a simple and inferior attempt to provide the function now offered by DDC. The line previously used for ID 1 is assigned by DDC1, DDC2B, and DDC2AB to carry data from the display device to the system unit. The line previously used for ID 3 is assigned by the DDC2B and DDC2AB to carry a clock signal between display device and the system unit to permit two-way communication of data between the display device and the system unit. It will thus be appreciated that, in a personal computer configuration comprising an older system unit and a DDC compatible display device, the device will produce either a "0" or a "1" on the line previously used for ID1, depending on the piece of DDC data the display device is transmitting at the time that the older system unit checks the ID bits in accordance with it's initialisation program. Assuming that ID bits 0 and 2 (which are not used by DDC) are grounded inside the connector shell, the older system unit would see ID bits of either "1010", or "1000". "1010" would be acceptable as this is an industry standard monitor ID bit pattern. However, "1000" is undefined as far as the older system unit is concerned, possibly leading to the system unit flagging a configuration error. Furthermore, the older system unit may see different ID bits at each boot up, thereby misleading the system unit into believing the that the display device has been changed. Again, a configuration error may result.

One known solution to the above problem is to introduce a mechanical two-position switch to the display device, with one switch position indicating DDC operation and the other position indicating ID bit operation. This solution has the disadvantages of increasing both product cost and physical complexity.

Another known solution is to introduce bi-directional FETs to the display device to make the critical ID bit lines (bits 1 and 3) go open circuit if ID bit mode is required. This solution is, again, complex and expensive to implement.

A further solution is to fit a dongle in series between the video adaptor of the older system unit and the display device. However, this solution is also expensive to implement.

In accordance with the present invention, there is now provided display apparatus comprising: a display screen; display drive means for generating a picture on the display screen in response to picture information from an external video source releasably connectable to the display apparatus; user control means for adjusting the picture generated by the display drive means in response to a manual input; and selection means for selecting, in response to a configuration code input via the user control means, one of a plurality of sets of control data for communication to the video source.

This advantageously permits the display to be selectively configured, via the user controls, to communicate with a computer system unit in accordance with any one of a plurality of communication protocols, such as DDC, DDC2B, DDC2AB, or conventional ID bit protocols, for example.

Preferably, the selection means comprises memory means for storing the sets of control data. The memory means preferably comprises a nonvolatile memory for storing at least one of the sets of control data.

In a preferred embodiment of the present invention, said one set of control data stored in the non-volatile memory comprises Extended Display Identification Data file for sequential communication to the video source.

At least of the sets of control data preferably comprises an N bit identification word for parallel presentation to the video source.

Preferably, the plurality of sets of control codes comprises a first set of control codes and a second set of control codes, wherein the selection means switches between the first set and the second set upon receipt of the configuration code.

The user control means preferably comprises a user control panel having a key pad including a plurality of manually actuable buttons. In one preferred embodiment of the present invention, the configuration code is supplied to the selection means in response to simultaneous depression of a plurality of the buttons. In another preferred embodiment of the present invention, the configuration code is supplied to the selection means in response to depression of a plurality of the buttons in a predefined sequence. In yet another preferred embodiment of the present invention, the configuration code is supplied to the selection means in response to depression of one of the buttons for a predefined period of time (15 seconds, for example). In a further embodiment of the present invention, the user control panel comprises a button dedicated to supplying the configuration code. In a particularly preferred embodiment of the present invention, the configuration code is preferably supplied to the selection means in response to simultaneous depression of two of the buttons.

In a particular preferred embodiment of the present invention to be described shortly, the display screen comprises a cathode ray tube display screen.

It will be appreciated that the present invention extends to a computer system comprising: computer memory means for storing a computer program instructions and data; processor means for executing the computer program instructions to manipulate the data; user input means for controlling execution of the program instructions by the processor means; a video source for generating picture information corresponding to data manipulated by the processor means; and display apparatus as described the above paragraphs for displaying a picture in response to picture information received from the video source.

A preferred embodiment of the present invention will now be described, by way of example only, with reference to the accompanying drawings in which.

Figure 1:
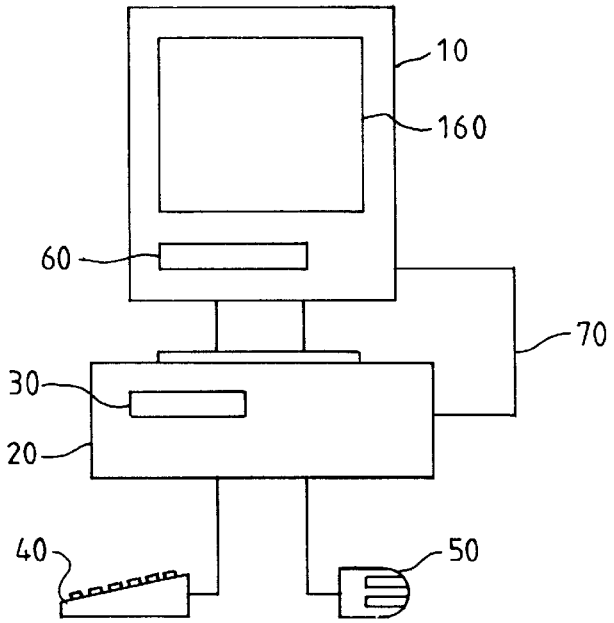
FIG. 1 is a block diagram of a personal computer system.

Referring first to FIG. 1, a personal computer system typically comprises a system unit 20; display apparatus 10 connected to a video adaptor (not shown) of system unit 20 via an interface cable 70, the display apparatus 10 having a screen 160 such as a cathode ray tube display, liquid crystal display panel, or the like; a keyboard 40 connected to a keyboard adaptor (not shown) of system unit 20; and, a mouse 50 connected to a pointing device adaptor (not shown) of system unit 20. Display apparatus 10 has a user control panel 60 comprising a pushbutton key-pad for permitting the user to adjust front of screen parameters such as brightness, contrast, picture height, picture width, etc. System unit 10 comprises a disk drive which may be for receiving a floppy disk, or alternatively a CD ROM, or similar portable storage medium.

As aforementioned, system unit 10 includes a memory (not shown) comprising a mass storage device such as a hard disk drive, for storing data and computer program instructions; and, a microprocessor for manipulating the data stored in the memory according to the instructions of the computer program. Keyboard 40 and mouse 50 are connected to system unit to permit a user to control execution of program code by system unit 10. Display apparatus 10 displays data manipulated by system unit 20 to the user.

Figure 2:
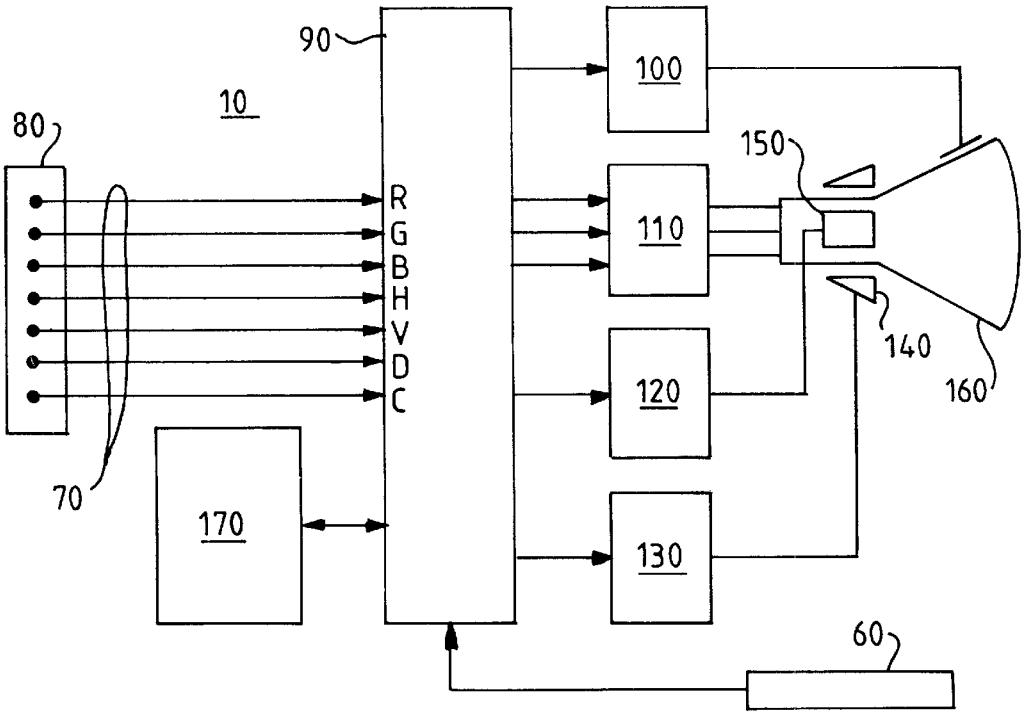
FIG. 2 is a block diagram of display apparatus of the present invention.

Referring now to FIG. 2, an example of display apparatus of the present invention comprises: a cathode ray display tube (CRT) 160. An Extra High Tension voltage (EHT) generator is connected to a final anode of CRT 160. A vertical deflection circuit 120 is connected to vertical scan coils 150 mounted on CRT 160. A horizontal deflection circuit 130 is connected to horizontal scan coils 140 mounted on CRT 160. Horizontal and vertical scan coils 140 and 150 are mounted on CRT 160 in a yoke assembly (not shown). A video amplifier 110 has red, green and blue channels respectively connected to red, green and blue electron guns of CRT 160. A display processor 90 is connected to horizontal deflection circuit 130, vertical deflection circuit 120, video amplifier 110, and EHT generator 100. Display processor 90 is connected to a memory 170. Push buttons of user control panel 60 are connected to inputs of display processor 90. Interface cable 70 terminates in a 15 pin D-shell connector 80 for receipt in a socket in the video adaptor of system unit 10. Cable 70 has 7 signal lines for carrying: red, green and blue video signals R, G, and B; horizontal and vertical synchronisation (sync) signals, H and V; DDC data D; and DDC clock C respectively for DDC2B and DDC2AB capability.

In operation, the video adaptor in system unit 10 generates red, green and blue video signals R, G and B, and corresponding horizontal and vertical sync signals H and V. In display apparatus 10, red, green, and blue electron beams are accelerated from a electron guns in the neck of CRT 160 to the screen by an extra high tension voltage of typically 24 kv generated by EHT generator 100. The electron beams are scanned across the screen in a raster pattern by vertical and horizontal magnetic scan fields produced by vertical and horizontal sawtooth scan currents flowing in vertical and horizontal deflection coils 150 and 140. The vertical and horizontal scan currents are generated by vertical and horizontal deflection circuits 120 and 130. Video amplifier 110 modulates each electron beam in accordance with a corresponding one of the R, G and B video signals. The modulated electron beams excite a phosphor coating on the screen of CRT 160 to produce a picture. It will be appreciated that in some embodiments of the present invention, EHT generator 100 and horizontal deflection circuit 130 may be combined. Display processor 90 synchronises the scan currents generated by the horizontal and vertical deflection circuits 130 and 120 to the incoming sync signals H and V to align the picture information in the R, G and B video signals with the raster pattern traced by the electron beams. The user can adjust output parameters such as height, width, brightness, and contrast of the displayed picture according to personal preference by pressing corresponding button of the key pad in user control panel 60. Depression of one of the buttons causes an a signal to be sent to display processor 90. The source of the signal is then traced by display processor 90 and the appropriate control signals are sent to one or a combination of vertical deflection circuit 120, horizontal deflection circuit 130, EHT generator 100 and video amplifier 110, according to the adjustment required. A power supply, which supplies electrical power to the components of the display apparatus 10 by a power supply is not shown in the interests of clarity.

Memory 170 stores the aforementioned EDID indicative of the operational capabilities of the display apparatus 10. EDID comprises, for example, pixel clock rate, horizontal and vertical active time, horizontal and vertical blanking times, horizontal and vertical sync offsets and pulse widths, and horizontal and vertical image size. EDID typically occupies 128 bytes of memory 170. In operation, when the personal computer system is turned on, initial detection by display processor 90 of the vertical sync pulse v from system unit 20 triggers display processor 90 to place EDID from the memory 170 on the data line D of interface cable 70. Provided system unit 20 has a DDC compatible video adaptor and not a video adaptor which expects to detect ID bits on the data line of interface cable 70, system unit 20 receives the EDID from display apparatus 10 and automatically selects the correct device driver code accordingly.

The termination of data line D and clock line C of interface cable 70 can be switched between ID bit and DDC communication modes (or protocols) by entering a predetermined configuration code into display processor 90 via the user control panel 60. In ID bit mode, data line D and clock line C of interface cable 70 are each terminated in the display apparatus at either "1" or "floating" (floating is equivalent to "1"), or "0" to provide ID bits 1 and 3 to the video adaptor of system unit 20. This enables display apparatus 10 to be used with an older, non-DDC compatible, system unit 20 such as an IBM PS/2 personal computer. In DDC communication mode, data line D and clock line C are enabled by display processor 90 for DDC communications with system unit 20. In particular, data line D is enabled for transmission of the EDID from memory 170 to system unit 20 as described above. This enables display apparatus 10 to be used with a DDC compatible system unit 20. In a particularly preferred embodiment of the present invention, the configuration code is entered by the action of simultaneously pressing two buttons, such as Geometry and Colour Reset Buttons on user control panel 60. When display apparatus 10 is powered on, each time the configuration code is entered in this manner, display apparatus 10 is toggled between ID bit communication mode, and DDC communication mode. It will be appreciated however, that the user may only need to set the communication mode once, on installation of the personal computer system. It will also be appreciated that, in some embodiments of the present invention, the configuration code may be entered by depressing a single, dedicated button, or alternatively, by simultaneously or sequentially pressing more than two buttons. Only if display apparatus 10 is reconnected to a different system unit will a change in communication mode need to be considered. At least part of memory 170 is non-volatile for storing the basic control program of display processor 90. The communication mode, ID bit or DDC, is stored by 1 bit in the non-volatile portion, thereby enabling display apparatus 10 to "remember" the communication mode to which it has been set. When display apparatus 10 is powered on, the bit is changed each time the configuration code is entered via user control panel 60. At power up, display processor 90 reads the bit from memory and assigns connection of the relevant lines of interface cable 70 accordingly. Specifically, if ID Bit communication mode is selected, display processor 10 sets lines D and C to be inputs rather than outputs. At the video adaptor of system unit 20 therefore, lines D and C are seen as open circuit. Display apparatus 10 thus presents ID bits to system unit 20 as required, with system unit 20 reading open circuits as "1"s. In the preferred embodiment of the present invention hereinbefore described, lines D and C are connected directly to display processor 90. However, in other embodiments of the present invention, lines C and D may be connected to a dedicated DDC application specific integrated circuit (ASIC), such as the Microchip 24LC21 for example, connected to display processor 90. The input pins of this particular ASIC are not diode clamped to its power supply rails. Thus, lines C and D can be made to appear to be open circuit by simply removing power from the ASIC. Thus by controlling the power supply to the ASIC in accordance with the bit stored in the memory 170, display processor 90 can switch display apparatus 10 between ID bit and DDC communication modes.

In the preferred embodiments of the present invention hereinbefore described, the communication mode of display apparatus 10 is switchable between ID Bit and DDC. The selection of communication mode is achieved by entering a single configuration code via the user control panel, thereby causing display processor 90 to toggle between the two communication modes. However, it will be appreciated that, in other embodiments of the present invention, each of the two communication modes hereinbefore described may be assigned a different configuration code, both being entered via user control panel 60, with one combination of buttons being assigned to ID Bit communication mode, and another, different combination of buttons being assigned to DDC communication mode. It will also be appreciated that the present invention may be extended to permit selection of any one of three or more different communication modes, each having a different configuration code entered by pressing a different combination of buttons on user control panel 60. It will further be appreciated that in other embodiments of the present invention, the same combination of buttons may be pressed to sequentially select one of three or more communication codes. It will further be appreciated that, in each of the above cases, the selected communication code may be at least temporarily displayed on the screen of display apparatus 10 after selection or power-on, thereby informing the user of the communication mode presently selected. Still further, it will be appreciated that the communication mode may be selected from an on-screen menu of optional communication modes, the selection being effected via push-buttons of user control panel 60. It will further be appreciated that CRT 160 may comprise a touch sensitive screen with user control panel 60 itself being be provided in the form of a simulated key pad presented on the touch screen. Although the present invention has been hereinbefore described with reference to colour CRT display apparatus, it will be understood that the present invention is equally applicable to other forms of display apparatus such as those comprising monochrome CRTs or liquid crystal panels, or the like.

What is claimed is:

1. Display apparatus comprising: a display screen; display drive means for generating a picture on the display screen in response to picture information from a video source releasably connectable to the display apparatus; user control means for adjusting the picture generated by the display drive means in response to a manual input and for inputting of a configuration and selection means, located on the display apparatus, for selecting, in response to the configuration code input via the user control means, one of a plurality of sets of control data for communication by the display apparatus to the video source.

2. Apparatus as claimed in claim 1, wherein the selection means (90,170) comprises memory means (170) for storing the sets of control data.

3. Apparatus as claimed in claim 2, wherein the memory means (170) comprises a non-volatile memory (170) for storing at least one of the sets of control data.

4. Apparatus as claimed in claim 3, wherein said one set of control data stored in the non-volatile memory (170) comprises Extended Display Identification Data file for sequential communication to the video source (20).

5. Apparatus as claimed in any preceding claim wherein at least one of the sets of control data comprises an N bit identification word for parallel presentation to the video source (20).

6. Apparatus as claimed in any of preceding claims 1–4 wherein the plurality of sets of control codes comprises a first set of control codes and a second set of control codes, wherein the selection means (90,170) switches between the first set and the second set upon receipt of the configuration code.

7. Apparatus as claimed in any of preceding claim 1–4 wherein the user control means (60) comprises a user control panel having a key pad including a plurality of manually actuable buttons, wherein the configuration code is supplied to the selection means in response to depression of a plurality of the buttons.

8. Apparatus as claimed in claim 7, wherein the configuration code is supplied to the selection means (90,170) in response to simultaneous depression of two of the buttons.

9. Apparatus as claimed in any of preceding 1–4, wherein the display screen (160) comprises a cathode ray tube display screen.

* * * * *